US005339294A

United States Patent [19]

Rodgers

[11] Patent Number: 5,339,294

[45] Date of Patent: Aug. 16, 1994

[54] WATCH WITH LIGHT MEANS

[76] Inventor: Nicholas A. Rodgers, c/o Shaw & Co. SJO 892, P.O. Box 025216, Miami, Fla. 33102-521

[21] Appl. No.: 149,908

[22] Filed: Nov. 10, 1993

[51] Int. Cl.[5] ..... G04B 19/30

[52] U.S. Cl. ..... 368/67; 368/227

[58] Field of Search ..... 368/10, 67, 69, 227, 368/256

[56] References Cited

U.S. PATENT DOCUMENTS 3,855,784 12/1974 Foellner ..... 368/67

4,003,197 1/1977 Haser ..... 368/67

4,271,492 6/1981 Battista ..... 368/10

4,330,877 5/1982 Barnes ..... 368/67

4,417,819 11/1983 Migeon ..... 368/67

4,848,009 7/1987 Rogers ..... 34/137

*Primary Examiner*—Vit W. Miska

*Attorney, Agent, or Firm*—Dowell & Dowell

[57] ABSTRACT

A watch has a motion responsive switch having ON and OFF states and a circuit adapted to energize a light, visible on the watch, for a predetermined interval after an OFF to ON transition but then to maintain the light off until the next OFF to ON transition.

20 Claims, 2 Drawing Sheets

Figure 6:
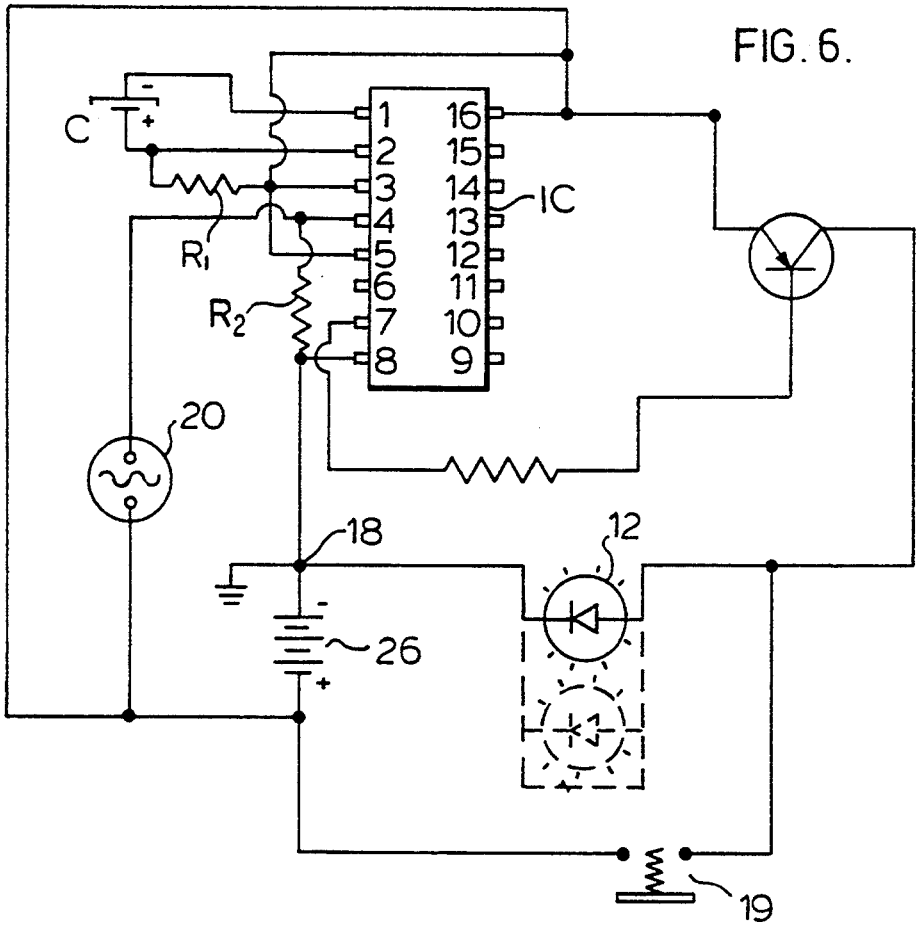

FIG.1.
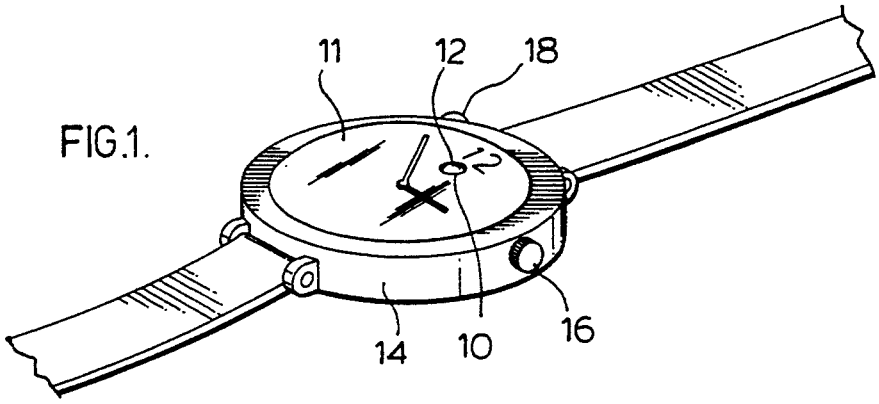
FIG.2.
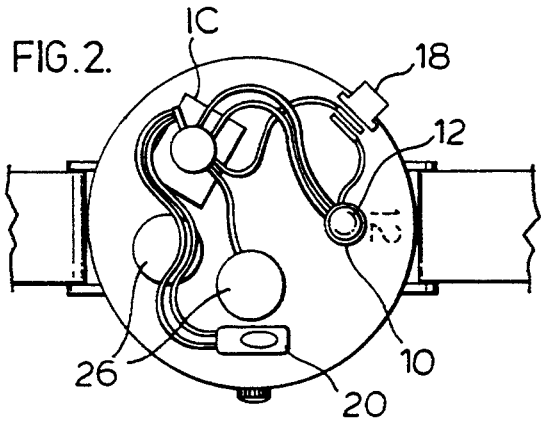
FIG.3.
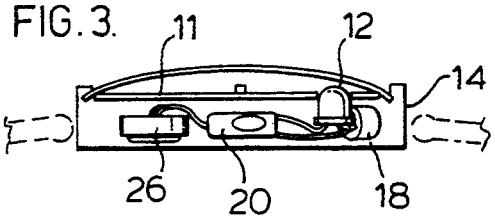
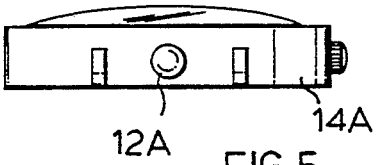
FIG.5.
FIG.4.
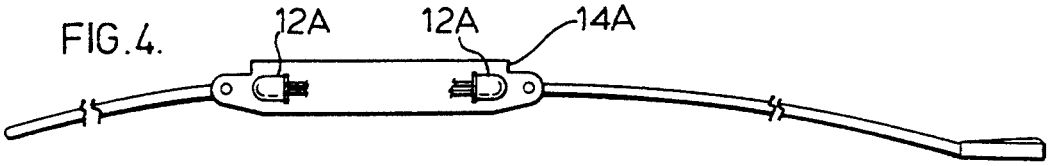

C
1
2
3
4
5
6
7
8
16
15
14
13
12
11
10
9
IC
R1
R2
20
18
12
26
19

20

7T1
7R4
7C1
12
7R5
7R2
7C2
18A
26
7R1
7R3
7T2

WATCH WITH LIGHT MEANS

This invention relates to a watch on which is mounted an exteriorly visible light and circuitry for controlling the ON and OFF states of said light.

By a light 'mounted on a watch' I include a light mounted on a strap for such watch. However, I believe it preferable that the light be mounted on, (or in) the casing of the watch itself.

In one aspect of the invention there is provided a watch with a light mounted thereon to be visible exteriorly of said watch, a battery for energizing the light, a circuit for selectively connecting said battery with said at least one light, switch means responsive to motion of the watch to connect said battery to said light to illuminate said light, including a switch designed to alternate between ON and OFF states, responsive to motion of said watch, and a circuit responsive to the transition of switch state from OFF to ON to turn off said light after a predetermined duration following said OFF to ON transition.

Thus, with this aspect of the invention the light will not remain on even if the switch remains in its ON state. The battery life is thus prolonged.

The light may have a number of purposes. It provides a novelty flashing effect. It may serve to indicate the wearer's location to others, in the darkness. It may, depending on choice of location, illuminate the watch 'dial' to allow the time to be read, in the darkness.

The light, as long as it is located to be visible, exterior to the watch, may have a number of possible locations. For example, one preferred location is in a placement to shine through an aperture or transparency in the watch face. Another preferred location is at one or at each end of the watch casing to light the adjacent area of the casing and light an extent of a transparent or translucent watch band.

Although an incandescent light is within the scope of the invention, such an incandescent light tends to require relatively high electrical energy tending to shorten battery life and to require circuit components of larger size.

Therefore it is preferred that light emitting diodes, 'LEDs' act as the light.

The use of LED's produces a bright display with a choice of a variety of colors which requires less energy than would the use of incandescent illumination, thus providing longer battery life. Moreover the battery and other circuit components may be of smaller size and cost. LEDs also provide a relatively high intensity relative to their power requirements.

In all aspects of the invention, it is noted that glass fibre may be used, if desired to conduct light from the light source to the exterior of the watch. In some cases glass fibres may be undesireable because they have a relatively narrow beam.

There are many alternatives available for the motion responsive means used in accord with the invention to switch the light source ON and OFF. It has been found that for ruggedness, operation and compactness that a mercury switch is preferred. In one aspect of the invention the circuitry only allows the light source to be illuminated on change of the switch to ON state and terminates the illumination after a predetermined period after the switch changes state from OFF to ON.

In a preferred aspect of the invention there is provided, in addition to the circuitry above described, additional circuitry including a manually operated switch designed when closed to connect the battery directly across the light independently of the circuitry previously described. This allows controlled illumination of the light for a self determined interval and allows the light to be used for illumination of the watch dial to allow the time to be read at night, or provides signalling capability. The additional switch is preferably normally open to ensure that the light is OFF, and battery power conserved, when the light is not needed.

By a 'manually operated' I include not only digitally operated but operation by pressure exerted by any other part of the wearer's body.

Figure 7:
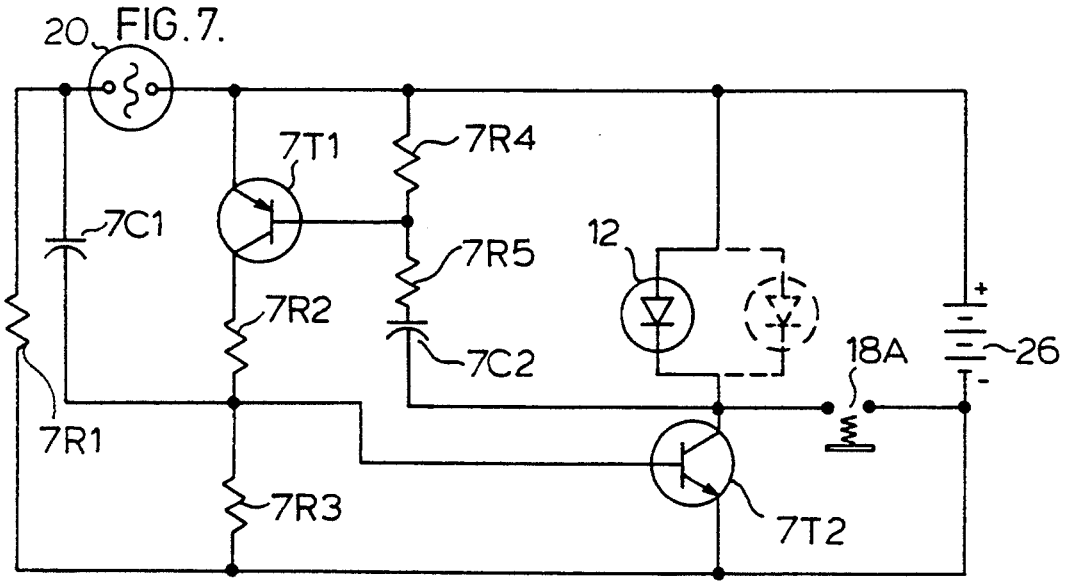

In drawings which illustrate preferred embodiments of the invention:

FIG. 1 is a perspective view of the outside of a watch and band incorporating the invention, showing an LED located to shine through the watch face, FIG. 2 is a partially schematic view of circuit elements arranged in the inside of a watch casing in plan view, FIG. 3 is a partially schematic view of the circuit elements of FIG. 2 in side view, FIG. 4 shows schematically an alternative form of the invention where two LED's are located to shine on and along a translucent watch strap, FIG. 5 shows an end view of the casing of FIG. 5 with the band removed, FIG. 6 is a schematic view of a circuit suitable for the embodiment of FIGS. 1–3. The FIG. 6 circuit is also suitable for the embodiment of FIGS. 5 and 6, and FIG. 7 shows a circuit as an alternative to that of FIG. 6 and suitable for the embodiments of FIGS. 1–3 or 4 and 5.

In the drawings, FIG. 1 shows a watch with moving hands and having an aperture 10 in the watch face 11 to pass rays from an LED 12 mounted inside the watch casing 14. As shown, the side of the casing mounts the usual time adjustment knob 16 but in addition mounts a depressable button 19 designed to act as the 'additional' normally open switch in the circuit to be described.

Before describing FIGS. 2 and 3 it should be noted that, in the inventive arrangement, there is provided a watch casing, mechanism or digital circuitry and the inventive circuit elements including an LED (or LEDs). The location of the watch face 11 and operating mechanism is predetermined by the manufacturer of these elements. The location of the LED is determined by the place on the watch from which it is desired that the LED rays emanate. The location of the normally open switch 19 is located in a suitable place for easy digital actuation. However, the remaining circuit elements are arranged anywhere in the particular casing where they may be located without interfering with the watch face or mechanism. Thus while the location of the batteries, integrated circuit and circuit board and mercury switch, and their connections (to be discussed hereafter) are shown in a exemplary arrangement in FIGS. 2 and 3; it will be realized that (a) the physical locations of these members are not of importance and (b) the physical locations will alter for each different watch casing, face, crystal or mechanism.

The drawings of FIGS. 1–3 show the invention embodied in a watch with a circuit dial and moving hands. It will however be understood that the invention may equally be embodied in a watch of other shape or a watch using a digital time display with suitable circuitry for causing the digital display to indicate the time. In such embodiment the invention would provide an LED in or adjacent the face of the display, and optionally, an override button suitably located for digital actuation. The circuitry to be described will operate in the same way whether a moving hand or digital type of watch is associated therewith.

FIGS. 4 and 5 show an alternate physical arrangement for two LEDs 12. The LED shining through the watch face 11 of FIGS. 1-3 is replaced, in FIGS. 4 and 5, by an LED 12A shining out from diametrically opposed side walls of the watch casing 14A and in each case toward the end of the watch band. The remaining circuitry, not shown, will be as illustrated in FIGS. 2 and 3 and in the circuit drawings to follow. The watch band is, in this arrangement, preferably made of transparent or translucent plastic. Thus the light from an illuminated LED 12A only only illuminates its surroundings outside the watch casing, but light rays are carried along an extent of the watch band, from each LED, producing an unusual and pleasing effect.

Obviously the LED's may be located elsewhere than is shown in FIG. 1 or FIG. 4 or there may be provided as many LED's as desired in any combination of locations.

FIG. 6 shows one circuit for use with either the embodiment of FIG. 1 or that of FIG. 5. In FIG. 6 is shown circuitry including an integrated circuit used to time illumination of LED 12. It will be understood that switch 20, batteries 26, LED 12 may be located as indicated in FIGS. 1-3. The integrated circuit IC, transistor T and the remainder of the elements shown in FIG. 6 are located in the casing as shown in FIGS. 2 and 3 or otherwise if desired.

Preferred values for the circuit elements are as follows:

IC—INTEGRATED CIRCUIT #RR8503 MC14528
T—TRANSISTOR #2N3906
C—CAPACITOR 0.47 4F at 30 V
20—ACTIVATION SWITCH, MERCURY
12—LIGHT SOURCE (LED)
26—TWO BATTERIES, EACH OF 1½ V
R1—RESISTOR 1 MEGOHM ⅛ W
R2—RESISTOR 1 MEGOHM ⅛ W
R3—RESISTOR 1 MEGOHM ⅛ W (A mechanical or a piezotronic switch may be used as an alternative to mercury switch 20).

(The integrated circuit and transistor referred to above are both available from Motorola Canada Limited, 3125 Steeles Avenue East, North York, Ontario, Canada).

In operation, with the the switch 20 open and the circuit quiescent, capacity C will be charged to the value of battery 26 (here 3 V). Pin 4 of the integrated circuit will be held at 0 volts which is the voltage arbitrarily designated at node 18. The integrated circuit IC will be in reset condition having the effect that there will be a positive voltage at pin 7, rendering the transistor T non-conducting and maintaining the LEDs 12 off.

When motion or vibration of the watch causes switch 20 complete this circuit, (the switch has thus completed the transition from OFF to ON state), battery 26 and pin 4, the (binary '0' to binary '1') or 0V to 3V transition at pin 4 causes the integrated circuit to go to "set" condition causing pin 7 of IC to go to 0 volts. This causes transistor T to conduct, lighting LED 12. The set condition of IC connects pin 3 with node 18 and in a time determined by C and R1 the circuit is returned to reset condition, extinguishing LED 12 and allowing C to recharge. The circuitry is further designed so that switch 20 must be turned OFF and ON again before the integrated circuit can again be activated to set state.

It will be appreciated that the 'ground' shown at node 18 is instrument ground only and is unconnected to anything outside the watch. The choice of node 18 as 'ground' is somewhat arbitrary but assists on the description of the circuit.

The use of the circuitry shown in FIG. 6 transcends the need for an 'OFF' attitude of the switch 20 to conserve battery power as it ensures only one short illumination of the LED per switch 20 closure. This allows the watch to be held or left where, due to the attitude of the watch, switch 20 is closed, without continuing illumination of the LED and consequent battery 26 power depletion. (LED 12 is referred to in the singular as the above description as appropriate to the embodiment of FIGS. 1-3. If the embodiment of FIGS. 4 and 5 is used the terminology "LEDS 12" should be substituted) Battery 26 is referred to in the singular although it may be the series connection of two batteries.

When it is desired to voluntarily control the commencement and duration of the illumination, normally open push button switch 19, is closed to connect the battery directly across the LED or LED's, illuminating them. When switch 19 is open the LED's are extinguished.

In FIG. 7 is shown an alternate circuit to that of FIG. 6. In FIG. 7 the integrated circuit IC is replaced by discrete elements. A schematic distribution of these elements in the watch casing is not shown but it will be realized that they are placed as found convenient in the casing in spaces remaining below and about the watch mechanism or circuit while the LED's (always placed to be exteriorly visible) and override button 18A (actuable from outside the case) will be located as shown in FIG. 1 or FIG. 4 or otherwise.

Exemplary only values of the circuit elements of FIG. 7 are indicated below:

| | |
|---|---|
| 7 R1 | 1 MEGOHM |
| 7 R2 | 1 KILOHM |
| 7 R3 | 100 KILOHM |
| 7 R4 | 47 KILOHM |
| 7 R5 | 1 KILOHM |
| 7 C1 | .1 4F |
| 7 C2 | 10 4F |
| 7 T1 | 2N3906 PNP |
| 7 T2 | 2N3904 NPN |
| 12 | LIGHT SOURCES (LEDS) |
| 20 | ACTIVATION SWITCH, MERCURY |
| 18A | OVERRIDE SWITCH, NORMALLY OPEN PUSH BUTTON (A mechanical or a piezotronic may be used) |

FIG. 7 shows a simple one shot circuit with an override circuit added. Ignoring, initially the override circuit, that is assuming 18A is open then the remaining circuitry is as follows.

When mercury switch 20 is closed providing transition from OFF to ON state, it applies positive voltage to 7C1 and the base of 7T2 This will cause 7T2 to conduct. This, in turn, causes the LEDS 12 to turn on.

7T2 conducting also connects the negative side of 7C2 to the negative side of the battery. This will place the base of 7T1 at a potential less positive than its emitter which will cause it to conduct. 7T1 supplies positive voltage to the voltage divider 7R2 and 7R3 which supplies positive voltage to the base of 7T2. This will hold 7T2 on after 7C1 has charged and no longer conducts current to the base of T2.

The RC network formed by the resistors 7R4, 7R5 and 7C2 determine the length of time the LEDS will be on. When 7C2 charges, the potential on the base of 7T1 becomes less negative and 7T1 will cease to conduct. This, in turn removes the positive bias from the base of 7T2 which will turn off and current will cease to flow to the LEDS.

To repeat the cycle switch, 26 must be opened and then reclosed to provide new OFF to ON state of the switch.

Thus if, for any reason the switch 26 remains closed the LED's will be extinguished by the circuit described above after the illumination duration provided by the RC network.

When it is desired to voluntarily control the commencement and duration of the illumination, normally open push button switch 19, is closed to connect the battery directly across the LED or LED's 12, illuminating them. Switch 19 is opened the LED's are extinguished.

It cannot be said that the circuit of FIG. 6 is always preferable over that of FIG. 7 or vice versa. The circuitry of FIG. 7 is somewhat simpler. However, the circuitry of FIG. 6 may be made extremely compact. The integrated circuit of FIG. 6 may take advantages of a process called 'on board integrated circuitry'. In this process the integrated circuit, IC, is actually built into a (very small) circuit board and covered with a dot of epoxy. The size of the integrated circuit of FIG. 6 is about 3/16 inch in diameter and only 1/32 of an inch thick.

The circuits of FIG. 6 or FIG. 7 would require 3 V power but it is preferred to use two 1½. batteries in series. These batteries are collectively shown and referred to as battery 26.

I claim:

1. Watch comprising:

a timekeeping means, a display means for displaying the time generated by the timekeeping means, at least one light source mounted on said watch to be visible exteriorly thereof, a battery, a switch which alternates between OFF and ON states responsive to motion of said watch, a circuit to selectively electrically connect said battery with said at least one light source to illuminate said source, said circuit, responsive to the transition of said switch from OFF to ON state, to so connect said power source to said light source, and means for disconnecting said power source from said light source on the elapsing of a predetermined time period after said transition.

2. Watch as claimed in claim 1 including additional circuit means including a manually operable additional switch selectively adapted to connect said battery directly across said light source during the closure of said additional switch.

3. Watch as claimed in claim 2 wherein said additional switch is normall open.

4. A watch including:

a timekeeping means, a display means for displaying the time generated by the timekeeping means, at least one light source mounted on said watch to be visible exteriorly thereof, a battery for energizing said light source, means responsive to motion of said watch to cause illumination of said light source by said battery, including a switch which alternates between OFF and ON states, responsive to motion of said watch, and circuit means responsive to the transition of said switch from OFF to ON state adapted to cause illumination of said light source by said battery, and a timing circuit adapted to terminate said illumination a predetermined period after said transition.

5. Watch as claimed in claim 4 including additional circuit means including a manually operable additional switch selectively adapted to connect said battery directly across said light source during the closure of said additional switch.

6. Watch as claimed in claim 5 wherein said additional switch is normally open.

7. A watch as claimed in claim 1 wherein said light source is an LED.

8. A watch as claimed in claim 2 wherein said light source is an LED.

9. A watch as claimed in claim 4 wherein said light source is an LED.

10. A watch as claimed in claim 5 wherein said light source is an LED.

11. A watch as claimed in claim 1 wherein said switch is a mercury switch.

12. A watch as claimed in claim 2 wherein said switch is a mercury switch.

13. A watch as claimed in claim 3 wherein said switch is a mercury switch.

14. A watch as claimed an claim 4 wherein said switch is a mercury switch.

15. A watch as claimed an claim 5 wherein said switch is a mercury switch.

16. A watch as claimed in claim 6 wherein said switch is a mercury switch.

17. A watch as claimed in claim 7 wherein said switch is a mercury switch.

18. A watch as claimed an claim 8 wherein said switch is a mercury switch.

19. A watch as claimed an claim 9 wherein said switch is a mercury switch.

20. A watch as claimed in claim 10 wherein said switch is a mercury switch.

* * * * *